US008113912B2

(12) United States Patent
Tanaka

(10) Patent No.: US 8,113,912 B2
(45) Date of Patent: Feb. 14, 2012

(54) EYEGLASS LENS PROCESSING APPARATUS

(75) Inventor: Motoshi Tanaka, Gamagori (JP)

(73) Assignee: Nidek Co., Ltd., Aichi (JP)

( * ) Notice: Subject to any disclaimer, the term of this patent is extended or adjusted under 35 U.S.C. 154(b) by 825 days.

(21) Appl. No.: 12/184,587

(22) Filed: Aug. 1, 2008

(65) Prior Publication Data

US 2009/0036040 A1 Feb. 5, 2009

(30) Foreign Application Priority Data

Aug. 3, 2007 (JP) ..... P.2007-203471

(51) Int. Cl.
*B24B 51/00* (2006.01)
*B24B 9/14* (2006.01)

(52) U.S. Cl. ..... 451/5; 451/43; 451/449; 451/53

(58) Field of Classification Search ..... 451/43, 451/255, 256, 5, 53, 449, 60
See application file for complete search history.

(56) References Cited

U.S. PATENT DOCUMENTS

| | | | | |
|---|---|---|---|---|
| 5,347,762 | A | 9/1994 | Shibata et al. | |
| 6,538,573 | B2 | 3/2003 | Mizuno | |
| 6,790,124 | B2 | 9/2004 | Shibata | |
| 6,813,536 | B1 * | 11/2004 | Gottschald | 700/160 |
| 6,881,132 | B2 | 4/2005 | Mizuno | |
| 2003/0008603 | A1 * | 1/2003 | Mizuno | 451/64 |
| 2004/0053654 | A1 * | 3/2004 | Kokumai et al. | 463/1 |

FOREIGN PATENT DOCUMENTS

| | | | |
|---|---|---|---|
| JP | 05-208355 | A | 8/1993 |
| JP | 5-212661 | A | 8/1993 |
| JP | 2002-200559 | A | 7/2002 |
| JP | 2002-283236 | A | 10/2002 |
| JP | 2003-117827 | A | 4/2003 |
| JP | 2003-145328 | A | 5/2003 |

* cited by examiner

*Primary Examiner* — Robert Rose
(74) *Attorney, Agent, or Firm* — Sughrue Mion, PLLC

(57) ABSTRACT

An eyeglass lens processing apparatus includes: a processing chamber for processing the lens; a grinding water supply unit which includes a first switch unit for turning on/off a supply of grinding water to a first nozzle for ejecting grinding water toward a processing point of the lens; a cleaning water supply unit which includes a second switch unit for turning on/off a supply of cleaning water to a second nozzle for ejecting cleaning water for cleaning processing refuse of the lens scattered in the processing chamber. According to a selection signal indicating a material of the lens being plastic, the control unit controls the first switch unit to turn on the supply of the grinding water in whole processing processes, and controls the second switch unit to turn off the supply of the cleaning water in the whole processing processes.

8 Claims, 7 Drawing Sheets

EYEGLASS LENS PROCESSING APPARATUS

BACKGROUND OF THE INVENTION

The present invention relates to an eyeglass lens processing apparatus for processing an eyeglass lens.

An eyeglass lens processing apparatus is known in which an eyeglass lens chucked between lens chucks (lens rotary shafts) is processed by a roughing grindstone and a finishing grindstone disposed in a processing chamber. Such an apparatus includes grinding water supply means for supplying cooling grinding water to a contact portion between the grindstone and the lens so as to reduce a heat generated during a processing of the lens and to clean processing refuse attached to the lens. Additionally, since the processing refuse of the lens flies in the processing chamber due to a rotation of the grindstone or are accumulated in a drainage port provided at the bottom portion of the processing chamber during the processing of the lens (particularly, in case of a polycarbonate lens, etc. requiring a heat during the processing), some apparatuses include cleaning water supply means for flowing cleaning water to the downside of the processing chamber.

As a method of supplying a water to the inside of the processing chamber, there are known a water circulation type in which the water stored in a water tank is supplied by use of a pump and a water pipe direct connection type in which an electromagnetic valve is attached to a pipe extending from a water pipe and the water is directly supplied in terms of a water pressure of the water pipe.

Additionally, since drainage of the processing chamber contains the processing refuse, some apparatuses include a filter device such as a centrifugal separator for separating the water from the processing refuse. Such a filter device should be necessarily used in the water circulation type, and needs to be desirably used in the water pipe direct connection type.

In the known apparatus, since the cleaning water is supplied from the cleaning water supply means at a normal time during the processing of the lens irrespective of the material of the lens, a problem arises in that a water consumption amount is large. In order to improve the filtering (dewatering) efficiency by restricting a discharge of the dirty drainage upon using the filter device, it is desirable to reduce the water consumption amount during the processing.

SUMMARY OF THE INVENTION

A technical object of the invention is to provide an eyeglass lens processing apparatus capable of reducing a water consumption amount. Further, a technical object of the invention is to provide an eyeglass lens processing apparatus capable of improving the filtering (dewatering) efficiency of a filter device by restricting a discharge of dirty drainage.

In order to achieve the object, the present invention provides the following arrangements.

(1) An eyeglass lens processing apparatus comprising:

a processing chamber in which a lens chuck for holding an eyeglass lens and a roughing grindstone and a finishing grindstone for processing the lens are provided;

a grinding water supply unit which includes a first nozzle for ejecting grinding water, the grinding water ejected from the first nozzle being sprayed toward a processing point of the lens processed by the grindstones, a first tube for supplying the grinding water from a water service pipe or a water tank to the first nozzle, and a first switch unit for turning on/off a supply of the grinding water to the first nozzle;

a cleaning water supply unit which includes a second nozzle for ejecting cleaning water, the cleaning water ejected from the second nozzle cleaning processing refuse of the lens scattered in the processing chamber, a second tube for supplying the cleaning water from the water service pipe or the water tank to the second nozzle, and a second switch unit for turning on/off a supply of the cleaning water to the second nozzle;

a lens material selection unit which inputs a selection signal for a material of the lens; and a control unit which controls each driving of the first and second switch units on the basis of the selection signal for the material of the lens, wherein on the basis of the selection signal indicating plastic, the control unit controls the first switch unit to turn on the supply of the grinding water in whole processing processes, and controls the second switch unit to turn off the supply of the cleaning water in the whole processing processes or temporarily turn on the supply of the cleaning water for a short time compared to the whole processing processes.

(2) The eyeglass lens processing apparatus according to (1), wherein the first switch unit includes a first electromagnetic valve or a first suction pump.

(3) The eyeglass lens processing apparatus according to (1), wherein the second unit is a second electromagnetic valve or a second suction pump.

(4) The eyeglass lens processing apparatus according to (1), wherein on the basis of the selection signal indicating the plastic, the control unit controls the second switch unit to temporarily turn on the supply of the cleaning water after ending the whole processing processes or each processing process or temporarily turn on the supply of the cleaning water during the whole processing processes or each processing process.

(5) The eyeglass lens processing apparatus according to (1), wherein on the basis of the selection signal indicating polycarbonate or trivex, the control unit controls the first switch unit so that the supply of the grinding water is turned off in a roughing and a first-stage finishing and the supply of the grinding water is turned on in a second-stage finishing, and controls the second switch unit so that the supply of the cleaning water is turned on in the roughing or the roughing and the first-stage finishing and the supply of the cleaning water is substantially turned off in the second-stage finishing.

(6) The eyeglass lens processing apparatus according to (5), wherein the control unit controls the second switch unit to temporarily turn on the supply of the cleaning water after or just before ending the second-stage finishing.

(7) The eyeglass lens processing apparatus according to (1), wherein on the basis of the selection signal indicating acryl, the control unit controls the first switch unit so that the supply of the grinding water is turned on in a roughing, the supply of the grinding water is turned off in a first-stage finishing, and the supply of the grinding water is turned on in a second-stage finishing, and controls the second unit so that the supply of the cleaning water is turned off in the roughing, the supply of the cleaning water is turned on in the first-stage finishing, and the supply of the cleaning water is substantially turned off in the second-stage finishing.

(8) The eyeglass lens processing apparatus according to (7), wherein the control unit controls the second switch unit to temporarily turn on the supply of the cleaning water after or just before ending the second-stage finishing.

DETAILED DESCRIPTION OF PREFERRED EMBODIMENTS

Figure 1:
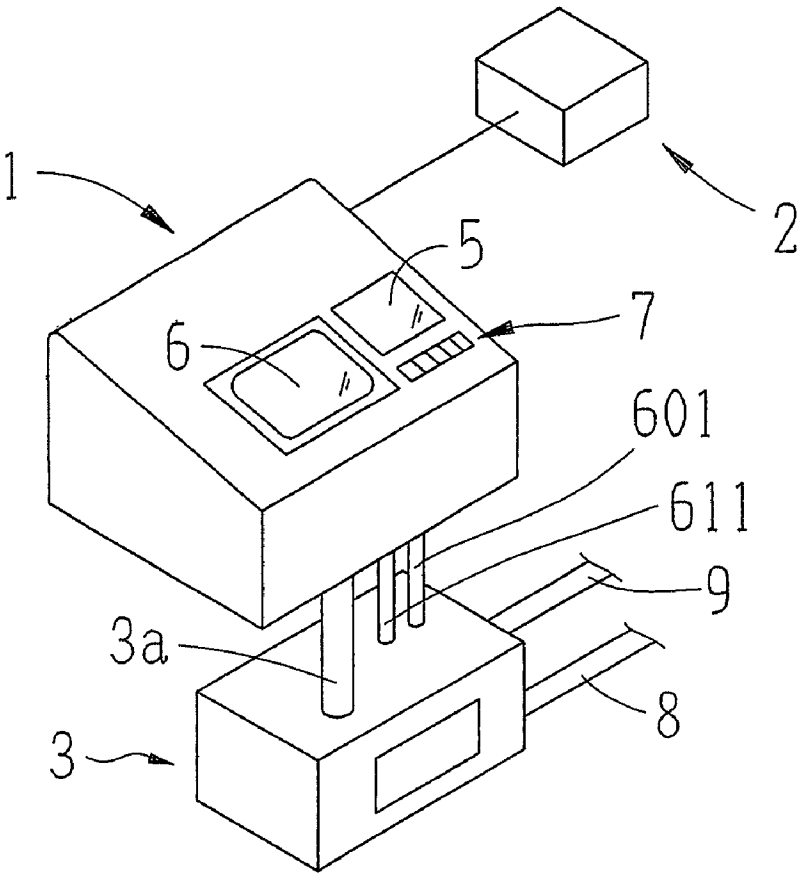
FIG. 1 is a schematic external diagram showing an eyeglass lens processing apparatus according to an embodiment of the invention.

Hereinafter, an exemplary embodiment of the invention will be described with reference to the accompanying drawings. FIG. 1 is a schematic external diagram showing an eyeglass lens processing apparatus 1 according to the embodiment of the invention. The processing apparatus 1 is connected to an eyeglass frame shape measurement device 2. As the measurement device 2, for example, the device disclosed in U.S. Pat. No. 5,347,762 (JP-A-H05-212661) may be used, and thus the description thereof will be omitted. A display unit 5 and a switch unit 7 are provided in the upper portion of the processing apparatus 1. The display unit 5 has a touch panel function, and serves as display means for displaying processing information and input means for inputting a processing condition, etc. A window 6 is opened or closed so that a lens is disposed in a processing chamber 20 (see FIG. 4) and a lens is taken out from the processing chamber 20

A water treatment device 3 having a centrifugal separator 650 (see FIG. 4) is disposed below the processing apparatus 1. Drainage containing processing refuse produced from the processing apparatus 1 during the processing of the lens is introduced into the water treatment device 3 via a drainage pipe 3*a*.

Figure 2:
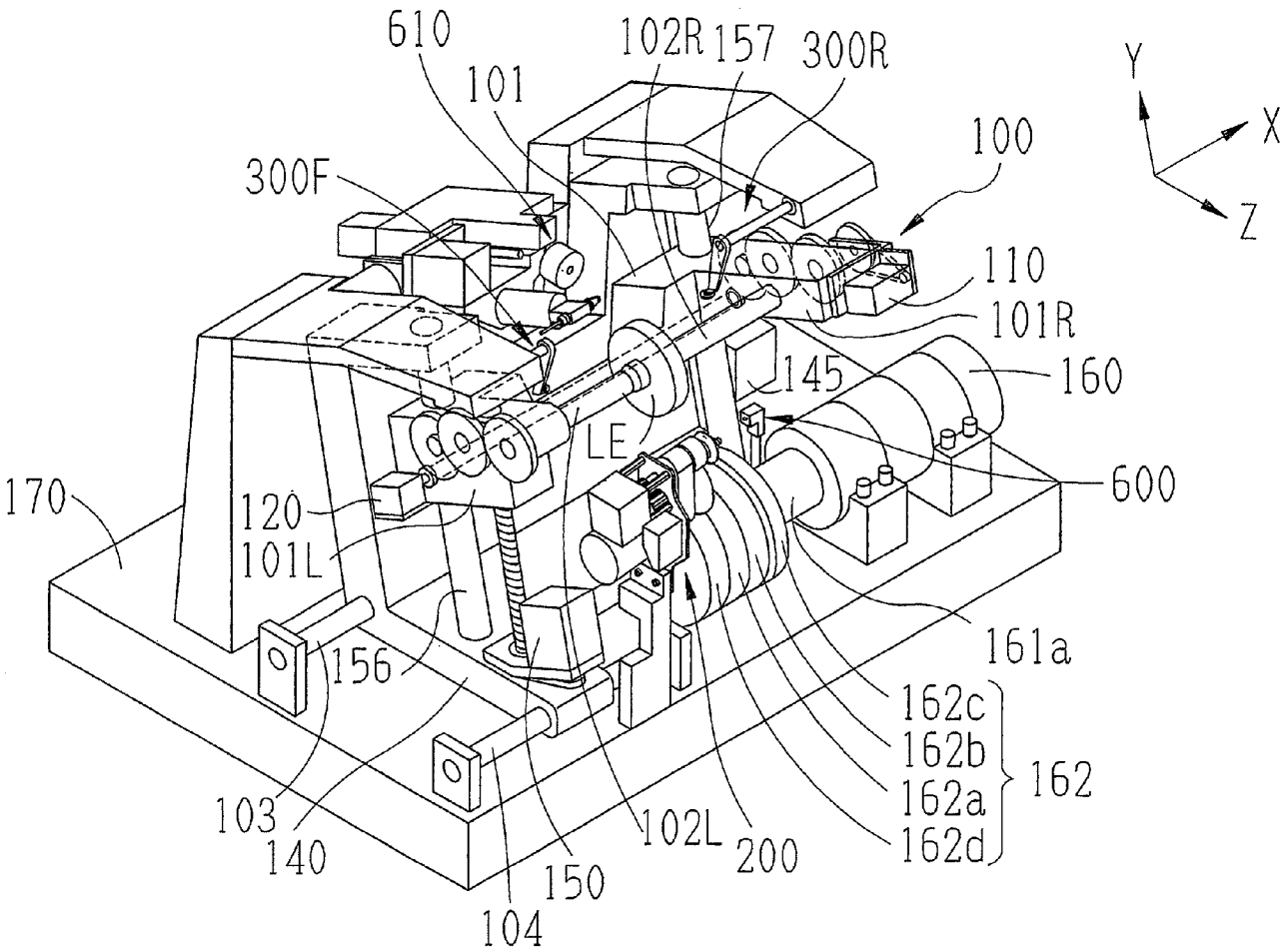
FIG. 2 is a schematic configuration diagram showing a lens processing portion.

FIG. 2 is a schematic configuration diagram showing a lens processing portion disposed in the processing apparatus 1. A carriage portion 100 is disposed on a base 170 of the processing apparatus 1, and a lens LE interposed between lens chucks (lens rotary shaft) 102L and 102R constituting a carriage 101 of the carriage portion 100 is subjected to a grinding using a grindstone 162 attached to a grindstone spindle (grindstone rotary shaft) 161*a* rotated by a motor 160, etc. The grindstone 162 includes a roughing grindstone 162*a* for plastic, a finishing grindstone 162*b* having a bevel-finishing groove and a flat-finishing surface, a polish-finishing grindstone 162*c* having a bevel-polish-finishing groove and a flat-polish-finishing surface, and a roughing grindstone 162*d* for glass.

The lens chuck 102L and the lens chuck 102R are coaxially held in a left arm 101L and a right arm 101R of the carriage 101, respectively, so as to be rotatable. The lens chuck 102R is moved toward the lens chuck 102L by a motor 110 attached to the right arm 101R, and the lens LE is clamped between the lens chucks 102R and 102L. The lens chucks 102R and 102L are rotated in a synchronizing manner by a motor 120 attached to the left arm 101L.

Shafts 103 and 104 are fixed to the base 170 so as to extend in an X direction in parallel to the lens chucks 102R and 102L and the spindle 161*a*, and a movement support base 140 is held thereto so as to be movable along the shafts 103 and 104. Shafts 156 and 157 are fixed to the support base 140 so as to extend in a Y direction in which a distance between the rotation axes of the lens chucks 102R and 102L and the spindle 161*a* varies, the carriage 101 is held thereto so as to be movable along the shafts 156 and 157. The support base 140 is moved by a motor 145 in the X direction, and the carriage 101 disposed on the support base 140 is moved in the X direction. The carriage 101 is moved by a motor 150 in the Y direction. Accordingly, the lens LE clamped between the lens chucks 102L and 102R is moved in the X direction and in the Y direction.

Figure 3:
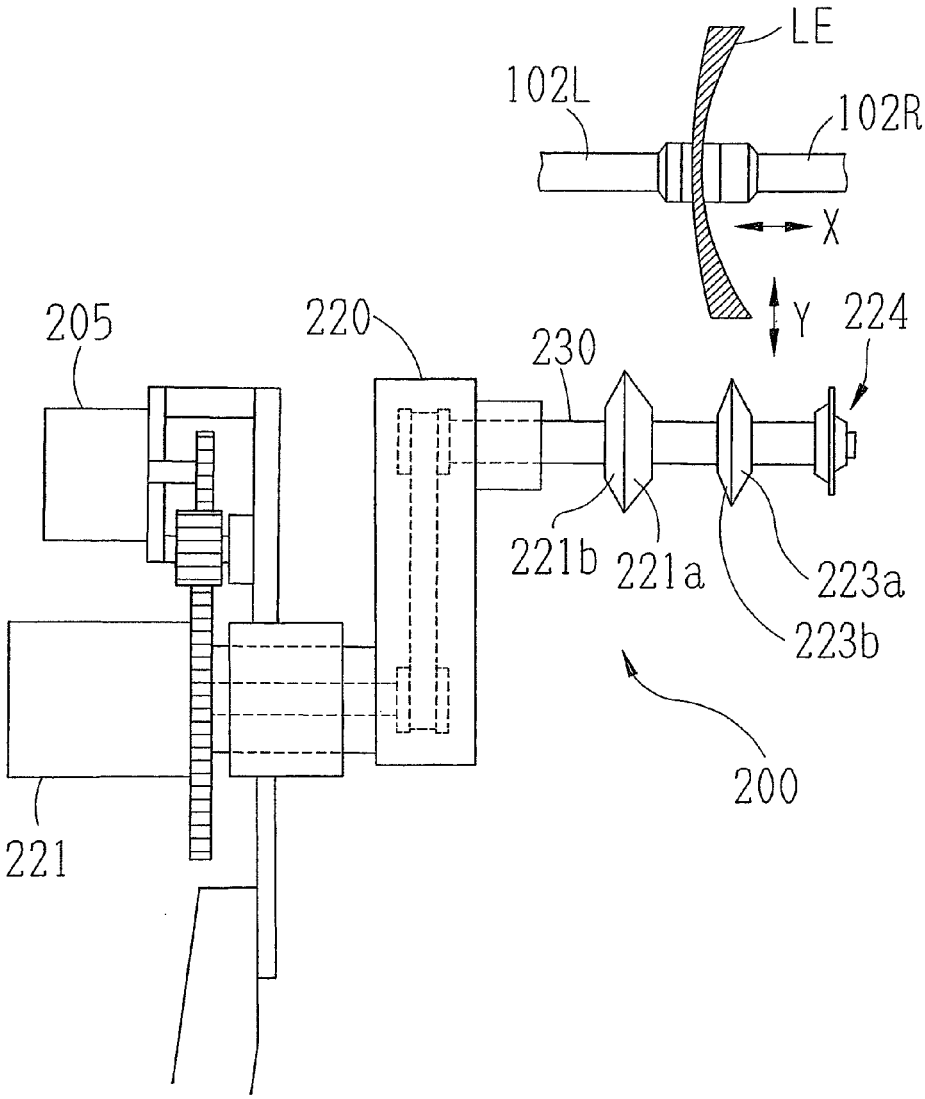
FIG. 3 is a schematic configuration diagram showing a chamfering-grooving portion.

A chamfering-grooving portion 200 is disposed in front of the processing apparatus 1. FIG. 3 is a schematic configuration diagram showing the chamfering-grooving portion 200. A lens front-edge chamfering grindstone 221*a*, a lens rear-edge chamfering grindstone 221*b*, a lens front-edge polish-chamfering grindstone 223*a*, a lens rear-edge polish-chamfering grindstone 223*b*, and a grooving grindstone 224 are coaxially attached to a grindstone spindle (grindstone rotary shaft) 230 rotatably held in an arm 220. The spindle 230 is rotated by a motor 221, and is moved between a retraction position and a processing position by a motor 205. The processing position of the spindle 230 is a position in which the rotation axis of the spindle 230 is in parallel to the rotation axis of the lens chucks 102R, 102L and the spindle 161*a* between the lens chucks 102R, 102L and the spindle 161*a* in a plane in which the rotation axes of the lens chucks 102R, 102L and the spindle 161*a* are located. In the same manner as the processing of the grindstone 162, in the processing of the chamfering-grooving portion 200, the lens LE is moved by the motor 145 in the X direction, and the lens LE is moved by the motor 150 in the Y direction.

The inner upper portion (upper portion of the carriage 101) of the processing apparatus 1 is provided with a lens front-edge position measurement portion (lens front shape measurement portion) 300F for measuring a lens front-edge position (lens front-edge path) and a lens rear-edge position measurement portion (lens rear shape measurement portion) 300R for measuring a lens rear-edge position (lens rear-edge path). As the measurement portions 300F and 300R, for example, the measurement portion disclosed in U.S. Pat. No. 6,790,124 (JP-A-2003-145328) may be used, and the description thereof will be omitted.

Figure 4:
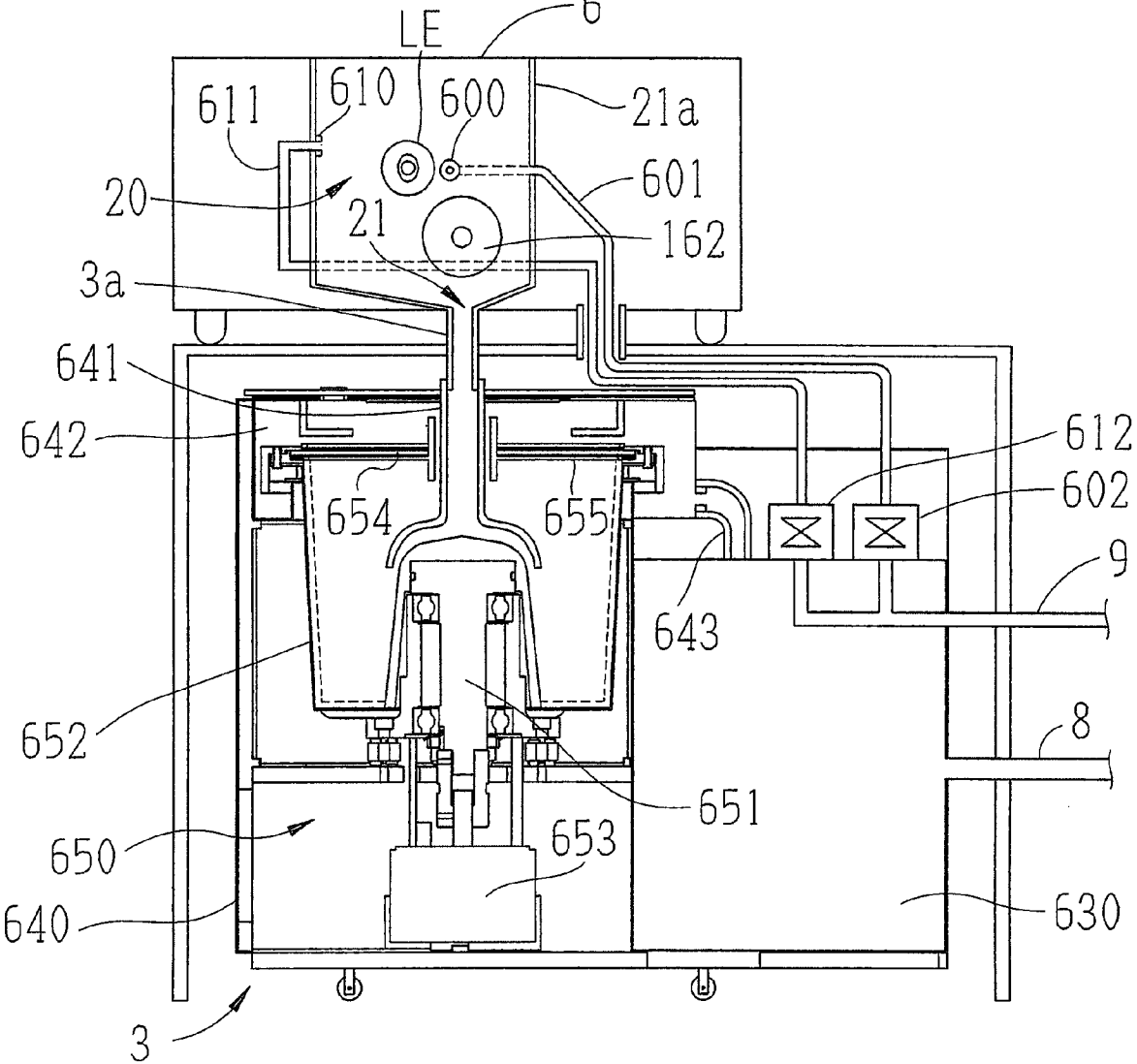
FIG. 4 is a schematic configuration diagram showing a water supply mechanism and a filter mechanism.

Next, a water supply mechanism for supplying water (grinding water and cleaning water) to the processing apparatus 1 and a filter mechanism for filtering drainage produced from the processing apparatus 1 during the processing of the lens LE will be described. FIG. 4 is a schematic configuration diagram showing the water supply mechanism and the filter mechanism.

An inner wall 21*a* on the right side (inner side of FIG. 4) of the processing chamber 20 in which the grindstone 162 is disposed is provided with a nozzle 600 for ejecting the grinding water to a contact portion (processing point) between the grindstone 162 and the lens LE. An ejection port of the nozzle 600 faces a direction in which the ejected grinding water goes past by a surface of the grindstone 162. The inner wall 21*a* on the inner side (left side of FIG. 4) of the processing chamber 20 is provided with a nozzle 610 for ejecting the cleaning water cleaning the inside of the processing chamber 20. The nozzle 610 is disposed above the grindstone 162. An ejection port of the nozzle 610 slightly faces the downside so as to clean processing refuse scattered in the processing chamber 20 and produced by the rotation of the grindstone 162 during the processing of the lens LE. Drainage containing the processing refuse is discharged from a drainage port 21 provided in the bottom portion of the processing chamber 20 via the drainage pipe 3*a*.

A tube 601 is connected to the nozzle 600, and the tube 601 is connected to a water supply pipe 9 via an electromagnetic valve 602. The nozzle 600, the tube 601, the electromagnetic valve 602, and the like constitute a first water supply unit for supplying the cooling grinding water. The nozzle 610 is connected to a tube 611, and the tube 611 is connected to the water supply pipe 9 via an electromagnetic valve 612. The nozzle 610, the tube 611, the electromagnetic valve 612, and the like constitute a second water supply unit for supplying the cleaning water. The water supply pipe 9 is connected to a water service pipe. The electromagnetic valves 602 and 612 is controlled to be opened or closed by a control unit 50 (see FIG. 5) described below. The electromagnetic valves 602 and 612 may be provided in a faucet of the water supply pipe 9 or water service pipe.

Since the cleaning water ejected from the nozzle 610 is used to clean the processing refuse attached to the inner wall 21*a* or the bottom surface of the processing chamber 20, the cleaning water is ejected so as to be broadly diffused.

A housing 640 of the water treatment device 3 is provided with the centrifugal separator 650 as the filter mechanism of the drainage, a water collection case 642, and a water tank 630. The drainage pipe 3*a* of the processing apparatus 1 is connected to a drainage pipe 641 of the housing 640. The drainage pipe 641 is attached to a top plate (upper surface) of the housing 640 so as to be located at the rotation center of the centrifugal separator 650.

The centrifugal separator 650 includes a motor 653 attached to the lower portion of the housing 640, a rotary shaft 651 connected to the motor 653, and a dewatering bin 652 attached to the rotary shaft 651. In the bottom portion of the dewatering bin 652, a center portion thereof is higher than a peripheral portion thereof.

An annular filter 654 for filtering the drainage is fixed to the upper portion of the dewatering bin 652 by a circular disk-shaped fixed member 655. The filter 654 has a mesh structure in which the water is transmitted and the processing refuse are hardly transmitted.

A drainage filtering operation using the centrifugal separator 650 will be simply described. The drainage containing the processing refuse produced from the processing apparatus 1 (processing chamber 20) is introduced into the dewatering bin 652 of the centrifugal separator 650 via the drainage pipe 3*a* and the drainage pipe 641. When the dewatering bin 652 is rotated by the motor 653, the processing refuse contained in the drainage are accumulated in the inner side of the dewatering bin 652, and the water separated from the processing refuse is sent to the upper outer side of the dewatering bin 652 so that the water is filtered by the filter 654 and is collected in the water collecting case 642. The water collected in the water collecting case 642 is first collected in the water tank 630 via a drainage pipe 643, and then is discharged to sewerage via a drainage pipe 8.

With the above-described configuration, the drainage containing the processing refuse produced from the processing apparatus 1 is separated into the water and the processing refuse in terms of the filtering (centrifugal separation), and the cleaned water is discharged to the sewerage via the drainage pipe 8.

Figure 5:
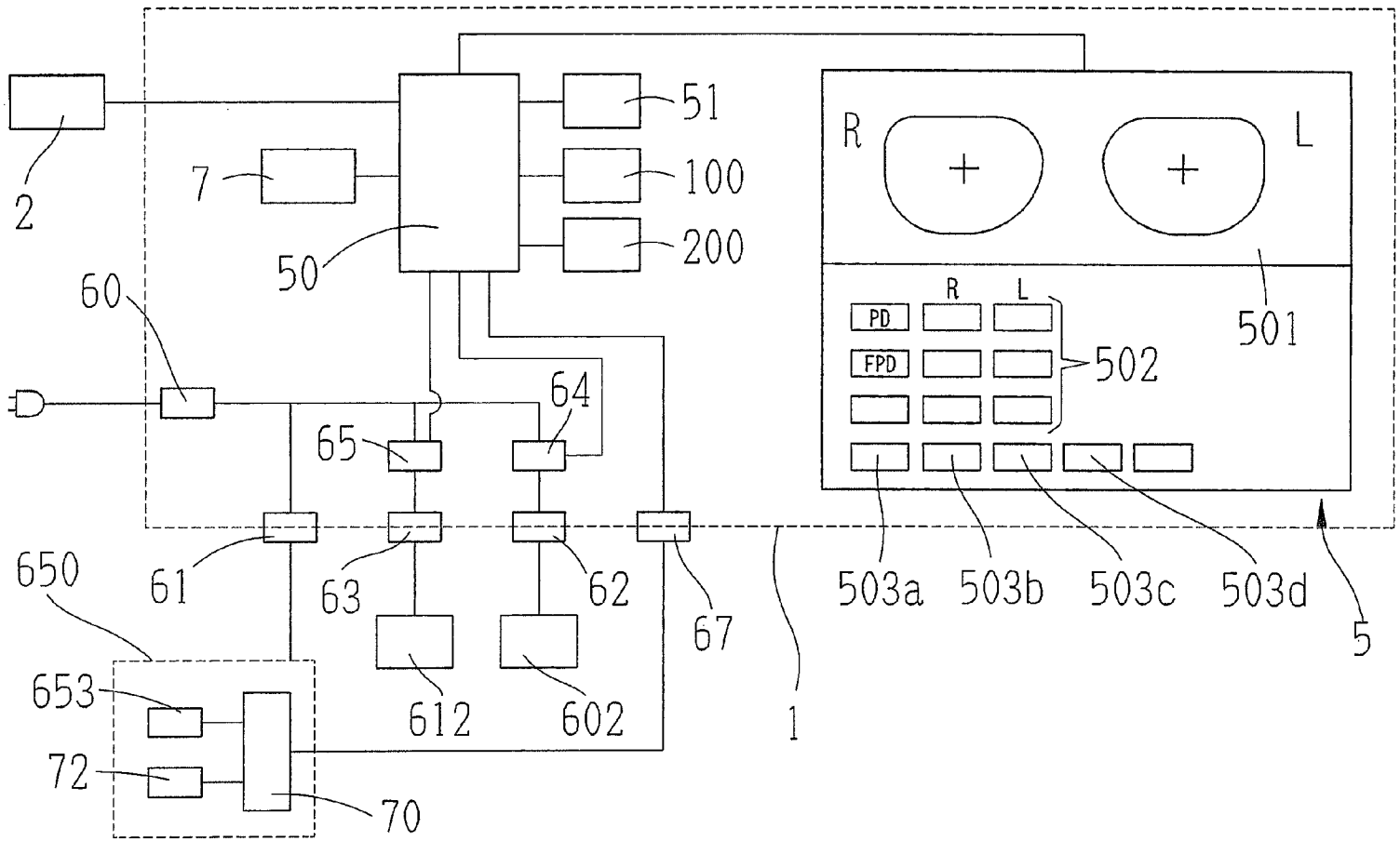
FIG. 5 is a schematic block diagram showing a water treatment control system of the processing apparatus having a water treatment device.

FIG. 5 is a schematic block diagram showing a water treatment control system of the processing apparatus 1 having the water treatment device 3. When a power supply switch 60 is turned on, electric power is supplied to the processing apparatus 1. Since a power supply cable of the centrifugal separator 650 is configured to be connectable to a power supply outlet 61 of the processing apparatus. 1, when the power supply switch 60 is turned on, the electric power is supplied to the centrifugal separator 650. The processing apparatus 1 is provided with power supply outlets 62 and 63 to which power supply cables of the electromagnetic valves 602 and 612 are connected. Relay switches 64 and 65 are provided in the course of the power supply lines of the power supply outlets 62 and 63. When the control unit 50 of the processing apparatus 1 turns on/oft the relay switches 64 and 65, the electromagnetic valves 602 and 612 are opened or closed.

A control unit 70 of the centrifugal separator 650 is connected to the control unit 50 via a signal connection gate 67. The control unit 70 is connected to a motor 653, an indicator 72 for displaying the number of sheets of the processing lenses, and the like.

An operation of the apparatus with the above-described configuration will be described. First, a processing condition for the lens LE is input. Data on a target lens shape (target outline) such as an eyeglass frame, a template (pattern), and a dummy lens (model lens) obtained by the measurement device 2 is input by an operation of the switch unit 7 and is stored in a memory 51. The figures of the obtained left and right target lens shapes are displayed on a screen 501 of the display unit 5. Layout data such as a wearer's pupillary distance (PD), a distance between centers of the left and right target lens shapes (FPD), and a height of an optical center with respect to the center of the target lens shape is input in terms of an operation of a layout key 502. In terms of a lens material selection key 503*a*, plastic, polycarbonate, trivex, acryl, glassy and the like are selected as the material of the lens LE to be processed. Additionally, in terms of a process mode selection key 503*b*, any one of a bevel-finishing mode, a flat-finishing mode, and a grooving mode is selected In terms of a processing mode selection key 503*c*, it is selected whether the polish-finishing is carried out. In terms of a processing mode selection key 503*d*, it is selected whether the chamfering is carried out.

Figure 6A:
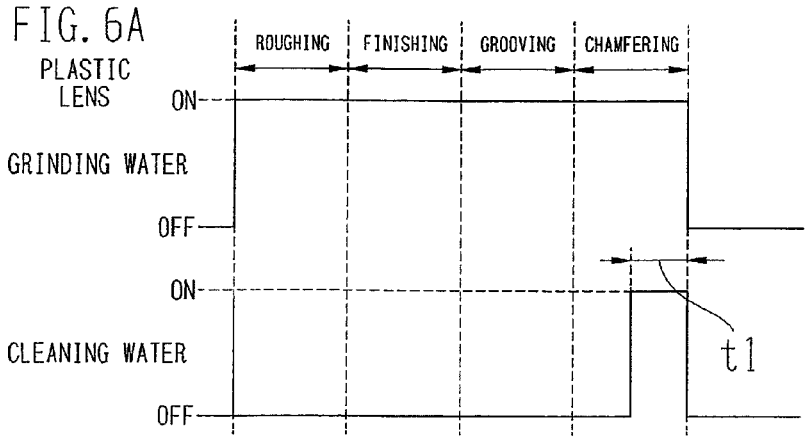
FIGS. 6A, 6B, and 6C are water-supply timing charts of a plastic lens, a polycarbonate lens, and an acryl lens, respectively.
Figure 6B:
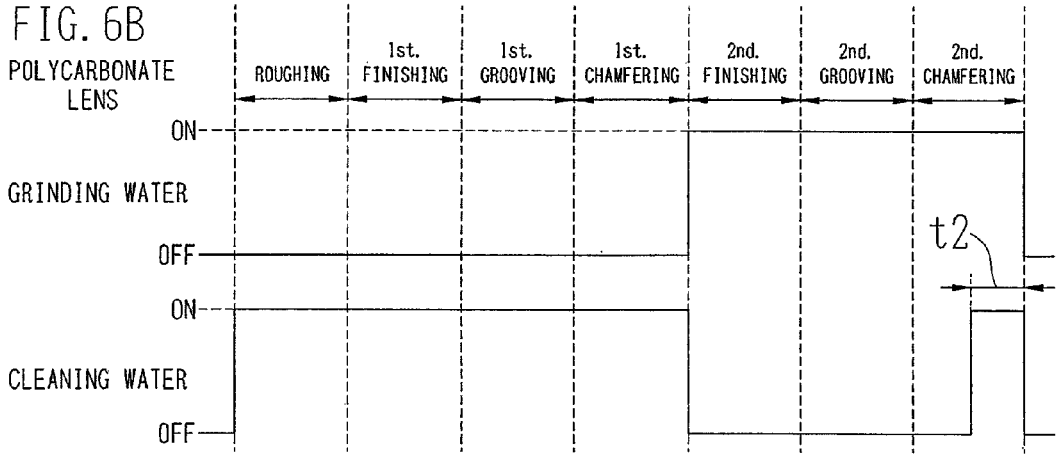
Figure 6C:
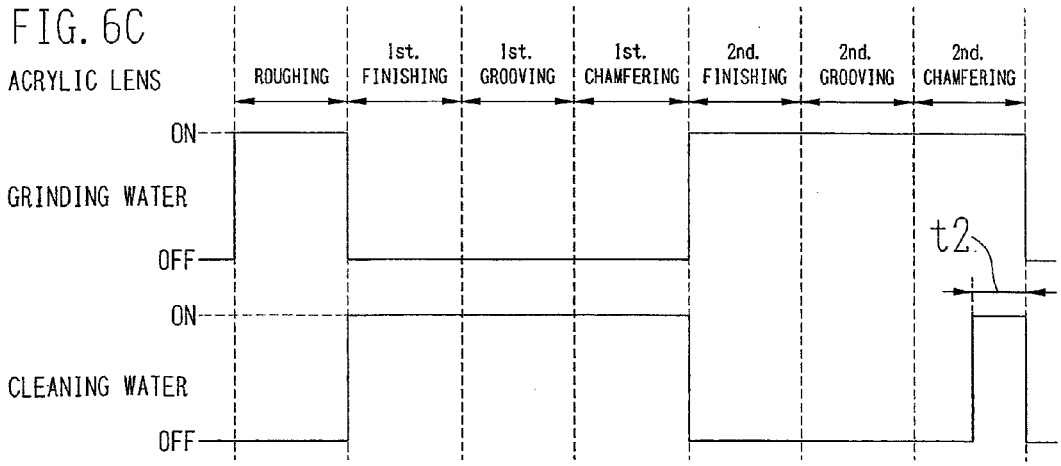

Next, the supply of the grinding water and the cleaning water in accordance with the material of the lens LE will be described with reference to FIGS. 6A to 6C. FIG. 6A is a water-supply timing chart in a case of a plastic lens, FIG. 6B is a water-supply timing chart in a case of a polycarbonate lens, and FIG. 6C is a water-supply timing chart in a case of an acryl lens. In the processing shown in FIGS. 6A to 6C, the grooving mode (roughing+flat-finishing+grooving) is selected, and additionally the chamfering is carried out.

<Plastic Lens Processing>

When plastic is selected as the material of the lens LE, the control unit 50 reads out a processing control program for processing the plastic lens from the memory 51, and starts the processing process.

When a start switch of the switch unit 7 is pressed after the lens LE is clamped between the lens chucks 102L and 102R, the measurement portions 300F and 300R measure the front and rear edge positions of the lens LE on the basis of the target lens shape data.

At this time, the control unit 50 transmits a processing start signal to the control unit 70 on the basis of an input signal of the start switch. The control unit 70 transmits a command signal to the motor 653 on the basis of the processing start signal output from the control unit 50, and starts a rotation of the dewatering bin 652.

When the measurement of the front and rear edge positions of the lens LE ends, the roughing continues. A position of the carriage 101 in the X direction is controlled so that the lens LE clamped between the lens chucks 102R and 102L is located on the roughing grindstone 162*a*, and a rotation of the lens LE and a position of the carriage 101 in the Y direction are controlled on the basis of roughing data, thereby performing the roughing to the lens LE using the roughing grindstone 162*a*. At this time, the roughing of the lens LE is carried out so that the final target lens shape has a remained (extra) portion to be processed during the finishing.

When the roughing ends, the finishing continues. When the grooving mode is selected, the flat-finishing is performed to the lens LE, having been subjected to the roughing, using the flat-finishing surface: of the finishing grindstone 162*b*. Subsequently, the grooving grindstone 224 moves to the processing position, and a rotation of the lens LE and a position of the carriage 101 in the X and Y directions are controlled on the basis of the grooving data based on the groove path data (which is calculated in the same manner as the bevel path data), thereby forming a groove in the edge surface of the lens LE, having been subjected to the flat-finishing, using the grooving grindstone 224. When the chamfering is selected, additionally, the front and rear edge angles of the lens LE are chamfered by the chamfering grindstones 221*a* and 221*b*.

In addition, when the bevel-finishing mode is selected, a rotation of the lens LE and a position of the carriage 101 in the X and Y directions are controlled on the basis of the bevel-finishing data based on the bevel path data, and a bevel is formed in the edge of the lens LE, having been subjected to the roughing, in terms of the bevel-finishing groove of the finishing grindstone 162*b*. The bevel path data is calculated by a general method on the basis of the measurement data of the front and rear edge positions of the lens LE and the target lens shape data. In the above-described processing processes, when plastic is selected as the material of the lens LE, as shown in FIG. 6A, the electromagnetic valve 602 is opened by the control unit 50 on the basis of a roughing start signal upon starting the roughing, and the grinding water starts to be supplied from the nozzle 600. In case of the plastic lens LE, since the processing refuse are prevented to be attached to the grindstone 162 and the lens LE by cooling the processing portion of the lens LE during the processing, it is possible to perform the processing with high precision. Basically, the grinding water is supplied at a normal time during each processing (the supply of the grinding water may stop temporarily upon moving to another processing). Then, the supply of the grinding water stops on the basis of an end signal of the final processing (here, the chamfering).

Meanwhile, the supply of the cleaning water from the nozzle 610 does not start even when the roughing start signal is generated. As shown in FIG. 6A, the electromagnetic valve 602 is opened when the final processing process ends (before or after the final processing ends), and the cleaning water is temporarily supplied for a predetermined time t1 (for example, 5 sec or so). For example, the supply of the cleaning water starts on the basis of a final processing process progress state (at the time the remaining processing amount becomes a predetermined amount), and the supply of the cleaning water stops on the basis of the end signal.

In case of the plastic lens LE, the processing refuse scattered in the processing chamber 20 and produced by the rotation of the grindstone 162 is in a form of powder, and the powder-like processing refuse accumulated in the bottom surface of the processing chamber 20 are flown together with the grinding water supplied from the nozzle 600 in a dissolved state. For this reason, even when the cleaning water is not supplied from the nozzle 610, the drainage containing the processing refuse is discharged via the drainage pipe 3*a* without blocking the drainage port 22 provided at the bottom portion of the processing chamber 20.

Additionally, in case of the plastic lens LE, the cleaning water may not be supplied from the nozzle 610 during the whole processing processes, but it is desirable to supply the cleaning water for cleaning the inner wall 21*a* of the processing chamber 20 at a stage when the processing of the lens LE ends as described above. Alternatively, the supply of the cleaning water may start on the basis of the final processing process end signal, and the supply of the cleaning water may stop after the predetermined time t1. Alternatively, the supply of the cleaning water may start on the basis of each processing process end signal (a signal moving to the next processing), and the supply of the cleaning water may stop after the predetermined time t1. That is, the cleaning water may be temporarily supplied after the whole processing processes or during each of processing processes.

As described above, in case of the processing process of the plastic lens LE, since the supply of the cleaning water of the nozzle 610 stops or temporarily continues for a short time, it is possible to remarkably save the water consumption amount. Since an amount of the drainage flowing to the centrifugal separator 650 during the processing process is reduced, it is possible to improve the separating efficiency (filtering (dewatering) efficiency) in which the water is separated from the processing refuse using the centrifugal separator 650. Further, it is possible to reduce an amount of the drainage discharged to the sewerage.

<Polycarbonate Lens Processing>

When polycarbonate is selected as the material of the lens LE, the control unit 50 reads out a processing control program for processing the polycarbonate lens from the memory 51, and starts the processing process. The description of the same processing process as that of the plastic lens will be omitted.

In the polycarbonate lens LE as thermoplastic resin, since a heat is necessary for processing the lens LE, the process is classified into a first stage of performing the processing process while stopping the supply of the grinding water and a second stage of performing the processing process while continuing the supply of the grinding water in order to remove burnt deposit formed in the processing portion of the lens LE.

As shown in FIG. 6B, in a state where the grinding water is not supplied from the nozzle 600 after the front and rear edge positions of the lens LE are measured, a roughing using the roughing grindstone 162*a*, a first-stage finishing using the finishing grindstone 162*b*, a first-stage grooving using the grooving grindstone 224, and a first-stage chamfering using the chamfering grindstones 221*a* and 221*b* are carried out. In the first-stage processing processes, the processing is carried out so that an extra portion is processed during a second-stage burnishing. When the first-stage final processing process (here, the chamfering) ends, a second-stage finishing using the finishing grindstone 162*b*, a second-stage grooving using the grooving grindstone 224, and a second-stage chamfering using the chamfering grindstones 221*a* and 221*b* are carried out. In the second-stage processing processes, the electromagnetic valve 602 is opened by the control unit 50 on the basis of the start signal, and the supply of the grinding water of the nozzle 600 starts. In the second-stage finishing of the polycarbonate lens, a heat of the processing portion of the lens LE reduces by supplying the grinding water, and the processing is carried out so as to be burnished. In the second-stage grooving and the second-stage chamfering, in the same manner, the processing is carried out so as to be burnished by supplying the grinding water.

As described above, in the polycarbonate lens LE, since the processing in the roughing and the first-stage processing processes cannot be carried out with high precision when a heat of the processing portion of the lens LE is not high, the supply of the grinding water stops. Meanwhile, the processing refuse of the polycarbonate lens LE is different from that of the plastic lens LE in that the processing refuse are attached to the inner wall, 21*a*, etc. of the processing chamber 20 to be a lump and the lump of the processing refuse is easily accumulated in the bottom surface of the processing chamber 20. When the lump of the processing refuse is directly accumulated in the drainage port 22, the drainage port 22 may be blocked. In order to prevent such a blocking, the electromagnetic valve 612 is controlled by the control unit 50 to be opened or closed so that the cleaning water is supplied from the nozzle 610 from the roughing start time to the first-stage chamfering end time (during a time when the grinding water is not supplied from the nozzle 600). Then, when the grinding water is supplied from the nozzle 600 after the second-stage finishing starts, the supply of the cleaning water of the nozzle 610 stops. In the second-stage processing processes, since the processing refuse are hardly produced, the processing refuse are not accumulated or the drainage port 22 is not blocked. Additionally, the cleaning water is supplied during at least the roughing, but since the processing refuse are hardly produced in the first-stage processing processes, the supply of the cleaning water may stop from the first stage. In this case, the supply of the cleaning water may stop on the basis of the roughing end signal.

By stopping the supply of the cleaning water in this manner, it is possible to save the water consumption amount. Since the drainage amount of the processing apparatus 1 is reduced, it is possible to improve the separating efficiency (filtering (dewatering) efficiency) using the centrifugal separator 650. Additionally, in the same manner as the plastic lens, the cleaning water may be temporarily supplied from the nozzle 610 so as to clean the processing chamber 20 for a predetermined time t2 (for example, 5 sec or so) before or after the final processing process ends or when the final processing process ends without a large variation in the water consumption amount.

Additionally, since the trivex is thermoplastic resin requiring a heat during the processing process in the same manner as the polycarbonate lens, and the material may be substantially subjected to the same processing sequences as that of the polycarbonate, even when the trivex is selected as the material of the lens LE, the supply of the grinding water and the cleaning water is controlled in the same manner as the case of the polycarbonate.

<Acryl Lens>

A point different from the case in which the polycarbonate lens is selected will be described. Since acryl has the lower melting point than that of the polycarbonate, the grinding water is supplied during the roughing. Subsequently, the first-stage finishing, the first-stage grooving, and the first-stage chamfering without the supply of the grinding water are carried out. Subsequently, for the burnishing, the second-stage finishing, the second-stage grooving, and the second-stage chamfering with the supply the grinding water are carried out. Since the grinding water is supplied during the roughing, the supply of the cleaning water stops during this time then, in the respective processing processes without the supply of the grinding water, the cleaning water is supplied so as to clean the scattered processing refuse. In the respective processing processes with the supply of the grinding water, the supply of the cleaning water stops again.

<Glass Lens>

When glass is selected as the material of the lens LE, in the same manner as the general method, basically, the grinding water and the cleaning water are supplied during the roughing and finishing. Upon processing the glass lens, the processing refuse of the glass lens is scattered in the processing chamber 20 in a form of glass pieces due to the rotation of the grindstone 162. When the cleaning water is not supplied, the glass pieces (processing refuse) are scattered in the processing chamber 20 to be attached to the window 6. For this reason, in case of the glass lens, in the same manner as the general method, it is desirable to supply both the grinding water and the cleaning water at a normal time during the processing process.

As described above, on the basis of the start signal and the end signal of each processing process, the supply of the grinding water and the cleaning water is controlled to be turned on/off, and the supply pattern of the grinding water and the cleaning water changes in accordance with the material of the lens LE, thereby reducing the water consumption amount of the apparatus 1. Accordingly, it is possible to reduce a cost of the service water and to reduce an amount of the drainage discharged to the sewerage.

Since the drainage amount for each sheet of the lens is reduced, a density of the processing refuse contained in the drainage increases, thereby improving the separating efficiency (filtering (dewatering) efficiency) in which the water is separated from the processing refuse using the centrifugal separator 650. Accordingly, it is possible to reduce the processing refuse contained in the drainage discharged to the sewerage.

As described above, although a case has been described in which the grooving and the chamfering are set as well as the roughing and the finishing, in the settings until the finishing in which the grooving and the chamfering are not set, the final processing process end is controlled by the finishing end.

Figure 7:
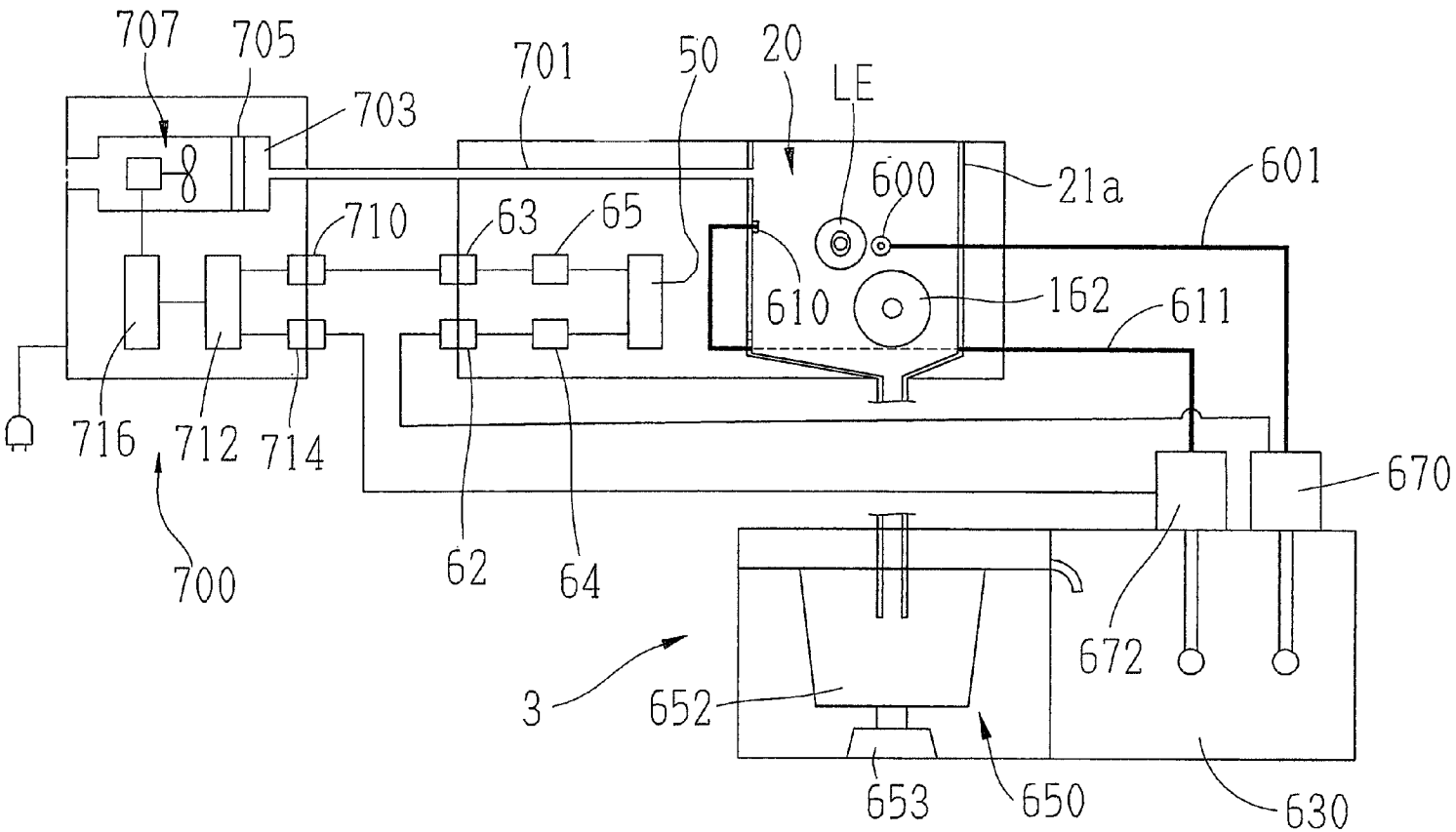
FIG. 7 is a diagram showing a configuration of an apparatus according to a modified example.

Next, a modified example of the configuration of the apparatus shown in FIG. 1 will be described with reference to FIG. 7. The exemplary configuration of the apparatus shown in FIG. 7 corresponds to a case in which the water supply mechanism is configured as a circulation-type mechanism. A deodorization device 700 is additionally provided so as to remove a bad odor generated during the processing process of the plastic lens (particularly, a high-refraction lens). For the brief explanation, the above-described components are schematically shown.

One end portion of an exhaust pipe 701 is connected to the processing chamber 20 of the processing apparatus 1, and the other end portion of the exhaust pipe 701 is connected to a deodorization chamber 703 provided with a deodorization filter 705 and an exhaust fan 707. When the exhaust fan 707 rotates, air containing the bad odor in the processing chamber 20 is sucked via the exhaust pipe 701. Then, the air containing the bad odor, reduced by the deodorization filter 705, is discharged to the outside.

The water tank 630 is disposed in the water treatment device 3, and a suction pump 670 is provided instead of the electromagnetic valve 602, and a suction pump. 672 is provided instead of the electromagnetic valve 612, respectively. In terms of the suction pump 670, the water stored in the water tank 630 is supplied to the nozzle 600 via the tube 601. In terms of the suction pump 672, the water stored in the water tank 630 is supplied to the nozzle 610 via the tube 611. A power supply cable of the suction pump 670 is connected to the power supply outlet 62 of the processing apparatus 1 The power supply outlet 63 of the processing apparatus 1 is connected to a power supply inlet 710 of the deodorization device 700 via a cable. A power supply cable of the suction pump 672 is connected to a power supply outlet 714 of the deodorization device 700, and the power supply inlet 710 and the power supply outlet 714 are connected to a relay switch 712. A timer 716 is connected to the relay switch 712, and an operation of the timer 716 starts at a time point when electric power is supplied from the processing apparatus 1. The exhaust fan 707 is driven by the timer 716, and the driving of the exhaust fan 707 stops by the timer 716 after a predetermined time.

In this modified example, instead of the electromagnetic valves 602 and 612 shown in FIG. 1, the pump 670 constituting a grinding water supply unit and the pump 672 constituting a cleaning water supply unit are controlled by the control unit 50.

Further, in the above-described embodiment, the supply stop of the grinding water and/or the cleaning water includes a case in which the grinding water and/or the cleaning water are/is supplied from the nozzle 600 and/or 610 without a large variation in the water consumption amount. Furthermore, in the above-described embodiment, although the cleaning water supplied from the nozzle 610 is mainly used to clean the inner wall 21*a* of the processing chamber 20, the invention is not limited thereto, but the cleaning water may be used to clean, for example, the bottom surface of the processing chamber 20.

What is claimed is:

1. An eyeglass lens processing apparatus comprising:

a processing chamber in which a lens chuck for holding an eyeglass lens and a roughing grindstone and a finishing grindstone for processing the lens are provided;

a grinding water supply unit which includes a first nozzle for ejecting grinding water, the grinding water ejected from the first nozzle being sprayed toward a processing point of the lens processed by the grindstones, a first tube for supplying the grinding water from a water service pipe or a water tank to the first nozzle, and a first switch unit for turning on and off a supply of the grinding water to the first nozzle;

a cleaning water supply unit which includes a second nozzle for ejecting cleaning water, the cleaning water ejected from the second nozzle cleaning processing refuse of the lens scattered in the processing chamber, a second tube for supplying the cleaning water from the water service pipe or the water tank to the second nozzle, and a second switch unit for turning on and off a supply of the cleaning water to the second nozzle;

a lens material selection unit which inputs a selection signal for a material of the lens; and a control unit which controls each driving of the first and second switch units on the basis of the selection signal for the material of the lens, wherein on the basis of the selection signal indicating plastic, the control unit controls the first switch unit to turn on the supply of the grinding water in whole processing processes, and controls the second switch unit to turn off the supply of the cleaning water in the whole processing processes or temporarily turn on the supply of the cleaning water for a short time compared to the whole processing processes.

2. The eyeglass lens processing apparatus according to claim 1, wherein. the first switch unit includes a first electromagnetic valve or a first suction pump.

3. The eyeglass lens processing apparatus according to claim 1, wherein the second unit is a second electromagnetic valve or a second suction pump.

4. The eyeglass lens processing apparatus according to claim 1, wherein on the basis of the selection signal indicating the plastic, the control unit controls the second switch unit in one of the following ways:

a) temporarily turning on the supply of the cleaning water after ending all of the processing processes;

b) temporarily turning on the supply of the cleaning water after each processing process;

c) temporarily turning on the supply of the cleaning water during all of the processing processes; and d) temporarily turning on the supply of the cleaning water during each processing process.

5. The eyeglass lens processing apparatus according to claim 1, wherein on the basis of the selection signal indicating polycarbonate or trivex, the control unit controls the first switch unit so that the supply of the grinding water is turned off in a roughing and a first-stage finishing and the supply of the grinding water is turned on in a second-stage finishing, and controls the second switch unit so that the supply of the cleaning water is turned on in the roughing or the roughing and the first-stage finishing and the supply of the cleaning water is substantially turned off in the second-stage finishing.

6. The eyeglass lens processing apparatus according to claim 5, wherein the control unit controls the second switch unit to temporarily turn on the supply of the cleaning water after or just before ending the second stage finishing.

7. The eyeglass lens processing apparatus according to claim 1, wherein on the basis of the selection signal indicating acryl, the control unit controls the first switch unit so that the supply of the grinding water is turned on in a roughing, the supply of the grinding water is turned off in a first-stage finishing, and the supply of the grinding water is turned on in a second-stage finishing, and controls the second unit so that the supply of the cleaning water is turned off in the roughing, the supply of the-cleaning water is turned on in the first-stage finishing, and the supply of the cleaning water is substantially turned off in the second-stage finishing.

8. The eyeglass lens processing apparatus according to claim 7, wherein the control unit controls the second switch unit to temporarily turn on the supply of the cleaning water after or just before ending the second-stage finishing.

* * * * *